US005484035A

United States Patent [19]

Wildner

[11] Patent Number: 5,484,035

[45] Date of Patent: Jan. 16, 1996

[54] TRAILER AND ENVIRONMENTALLY SAFE WORK PLATFORM SYSTEM

[76] Inventor: Robert J. Wildner, R.D. 2, Box 347A, Johnstown, Pa. 15904

[21] Appl. No.: 340,306

[22] Filed: Nov. 14, 1994

Related U.S. Application Data

[63] Continuation-in-part of Ser. No. 172,925, Dec. 27, 1993, Pat. No. 5,417,301.

[51] Int. Cl.[6] ..... E04G 1/22

[52] U.S. Cl. ..... 182/63; 182/141; 182/138

[58] Field of Search ..... 182/63, 141, 148, 182/129, 138, 150

[56] References Cited

U.S. PATENT DOCUMENTS

| | | | |
|---|---|---|---|
| 3,076,522 | 2/1963 | Goodell . | |
| 3,099,332 | 7/1963 | DeMarco | 182/148 X |
| 3,614,993 | 10/1971 | Penso . | |
| 3,638,757 | 2/1972 | Sampson . | |
| 3,858,688 | 1/1975 | Galloway . | |
| 3,891,055 | 6/1975 | Medlock . | |
| 3,937,301 | 2/1976 | Bertail . | |
| 4,429,764 | 2/1984 | Park . | |
| 4,529,063 | 7/1985 | Kishi . | |
| 4,614,251 | 9/1986 | Hawkins . | |
| 4,660,680 | 4/1987 | Potin . | |
| 4,741,413 | 5/1988 | Kishi . | |
| 4,848,516 | 7/1989 | Nakai et al. . | |
| 4,852,307 | 8/1989 | Goudeau . | |
| 4,930,598 | 6/1990 | Murrill et al. . | |
| 4,944,366 | 7/1990 | Pryor et al. . | |
| 4,962,828 | 10/1990 | Duncan . | |
| 4,967,733 | 11/1990 | Rousseau . | |
| 5,007,501 | 4/1991 | Baston . | |
| 5,011,710 | 4/1991 | Harrison . | |
| 5,065,838 | 11/1991 | Finley . | |
| 5,203,428 | 4/1993 | Beeche . | |
| 5,299,655 | 4/1994 | Margaritis . | |

FOREIGN PATENT DOCUMENTS 862165 1/1953 Germany .

OTHER PUBLICATIONS

Product Brochure of Swing-Lo Suspended Scaffold Co., Inc. of Covert, Michigan, dated Nov. 1987.

*Primary Examiner*—Alvin C. Chin-Shue
*Attorney, Agent, or Firm*—Banner & Allegretti, Ltd.

[57] ABSTRACT

A work platform assembly and trailer system for transporting and vertically positioning the work platform assembly adjacent bridge deck surfaces to be treated. The trailer includes front and rear lifting assemblies for supporting, and being removably attached to, an end of the work platform assembly. The lifting assemblies include vertically oriented lifting cylinders for vertically positioning the work platform assembly immediately adjacent the bridge deck surfaces to be treated. The trailer includes wheels and a hitch to facilitate the transport of the work platform assembly to the site of the bridge deck. The work platform assembly is modular in construction so as to be configurable according to the configuration and size, particularly width, requirements of each bridge and to metal surfaces thereof which are to be reconditioned by abrasive stripping and recoating. An adjustable curtain frame and/or other devices enable sealed enclosure of bridge surfaces to be treated and optimum access of workers to those surfaces during the treatment. Airborne residue is evacuated by vacuum into a dust collection system for subsequent disposal in a manner which does not contaminate the environment, while heavier residue and spent abrasive grit is collected and positively moved off of the platform assembly into a residue separation system for subsequent, environmentally safe separation and reconstitution of the grit for reuse. The dust collection and residue separation systems may be removably attached to the trailer.

26 Claims, 14 Drawing Sheets

TRAILER AND ENVIRONMENTALLY SAFE WORK PLATFORM SYSTEM

CROSS-REFERENCES TO RELATED APPLICATIONS

This application is a continuation-in-part of U.S. patent application Ser. No. 08/172,925 filed Dec. 27, 1993, U.S. Pat. No. 5,417,301, issued May 23, 1995, entitled *ENVIRONMENTALLY SAFE WORK PLATFORM*, which is hereby incorporated by reference.

BACKGROUND OF THE INVENTION

This invention relates to a trailer for transporting a modular work platform assembly to a work site. More specifically, this invention relates to a trailer for transporting and vertically positioning a modular work platform assembly adjacent metal bridge deck surfaces enabling workers to treat the surfaces, particularly for removing rust and paint by blasting the surfaces with particles.

OSHA regulations provide stringent requirements for containment of any debris resulting from such treatment and capable of contaminating the surrounding environment, both during and after the treatment. Further, from an economic standpoint, it is preferable to collect, clean and reuse the particles used in abrasive blasting. Additionally, these work platforms have typically been difficult to transport to the work site and have also been difficult to position adjacent the surfaces to be treated.

SUMMARY OF THE INVENTION

Thus, an object of the invention is to provide a work platform assembly upon which workers are supported so that they can stand and walk to address the metal surfaces to be stripped and recoated, while improving upon previous attempts at containing and collecting the contaminating airborne debris and heavier, spent particles in a manner which is safe for the environment. Such, an assembly is disclosed in copending U.S. patent application Ser. No. 08/172,925 filed Dec. 27, 1993, which has been incorporated herein by reference.

Another object of the invention is to provide a trailer for facilitating the transport of the work platform assembly to the desired work site. The trailer is capable of vertically adjusting the height of the work platform assembly to a position directly underneath a bridge deck to create a substantially sealed enclosure. This especially facilitates the treatment of a bridge deck when the bridge deck is an overpass to an existing road.

These and other objects are achieved by the present invention which, according to one aspect, provides an apparatus for treating a bridge deck surface at a predetermined location. The apparatus includes a trailer and work platform assembly removably attached to the trailer. The trailer transports and vertically positions the work platform assembly to the underside of a bridge deck. The work platform assembly provides support for worker access and for the treatment of surfaces of supporting structures of the bridge deck. The work platform assembly includes an assembly frame having a front end and a rear end, a trough extending longitudinally of the work platform assembly for collecting particulate material at a bottom thereof, grating positioned atop the trough for supporting a worker thereon and allowing particulate material to pass therethrough into the trough, a conveyor for discharging the particulate material from the trough, and front and rear lifting interfaces. The front and rear lifting interfaces are attached to the trailer. The front lifting interface is located adjacent the front end of the assembly frame, while the rear lifting interface is located adjacent the rear end of the assembly frame. The trailer includes a substantially horizontal trailer bed having a front portion and a rear portion, wheels for rollingly supporting the trailer bed on a supporting surface, front and rear lifting assemblies, front and rear fastening devices, and a fluid control system. The front and rear lifting assemblies are respectively fixedly attached to the front and rear portions of the trailer bed. Each lifting assembly includes a lifting frame and at least one lifting cylinder. The lifting frame of the front lifting assembly supports the front end of the assembly frame of the work platform assembly. The lifting frame of the rear lifting assembly supports the rear end of the assembly frame of the work platform assembly. The front fastening device removably attaches the front lifting interface of the work platform assembly to the lifting frame of the front lifting assembly, and the rear fastening device removably attaches the rear lifting interface of the work platform assembly to the lifting frame of the rear lifting assembly. Each lifting cylinder is substantially vertically oriented and has a lower end structurally coupled to the trailer bed and an upper end structurally attached to its respective lifting frame. The fluid control system is operatively coupled the lifting cylinders for controlling the flow of fluid to and from the lifting cylinders, causing the lifting cylinders to extend or retract, and further causing the lifting frames and the work platform assembly to move substantially vertically with respect to the trailer bed.

These and various other novel features of the invention will become more apparent from the following disclosure.

DETAILED DESCRIPTION OF THE INVENTION

Figure 1:
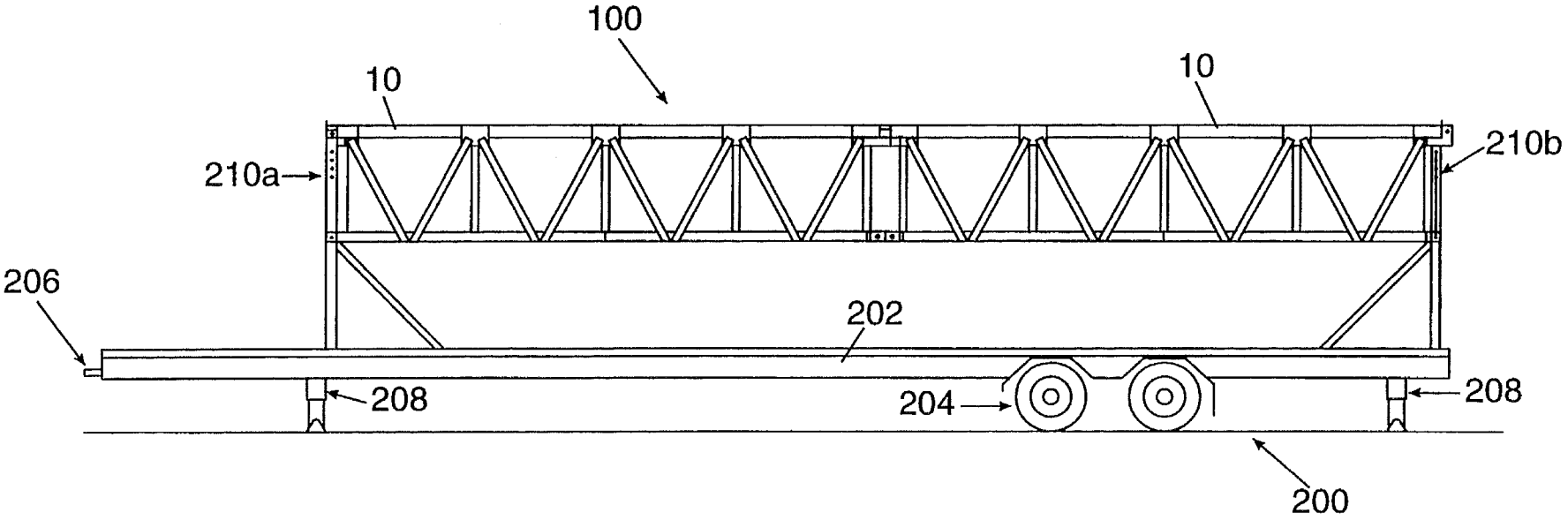
FIG. 1 is a side elevational view of the trailer and the work platform assembly of the present invention, with the work platform assembly shown in its lowered transport position.
Figure 3:
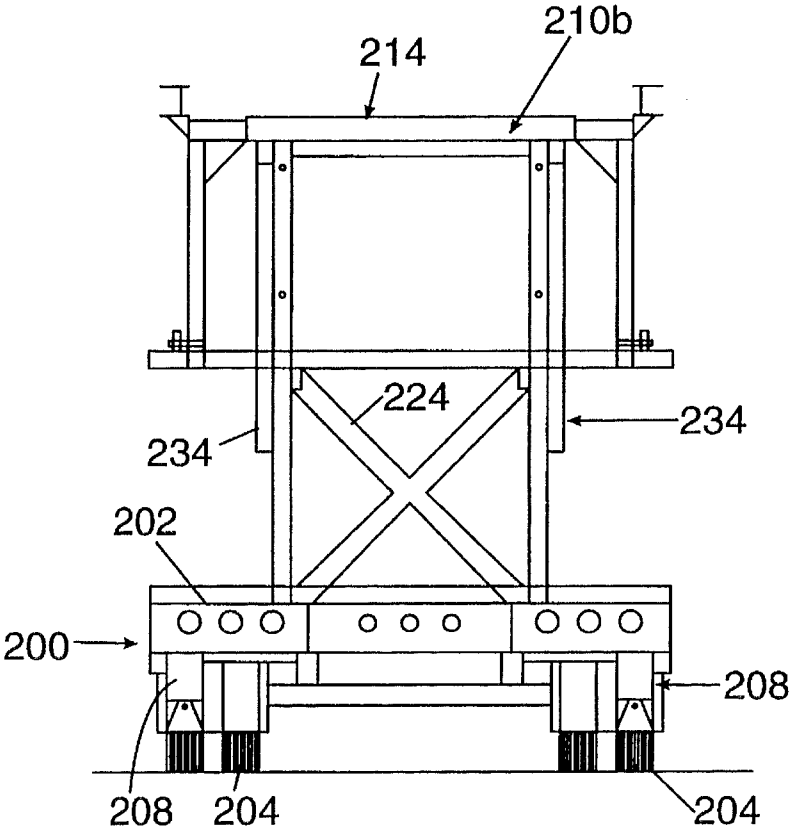
FIG. 3 is a rear elevational view of the trailer and the work platform assembly of FIG. 1.
Figure 2:
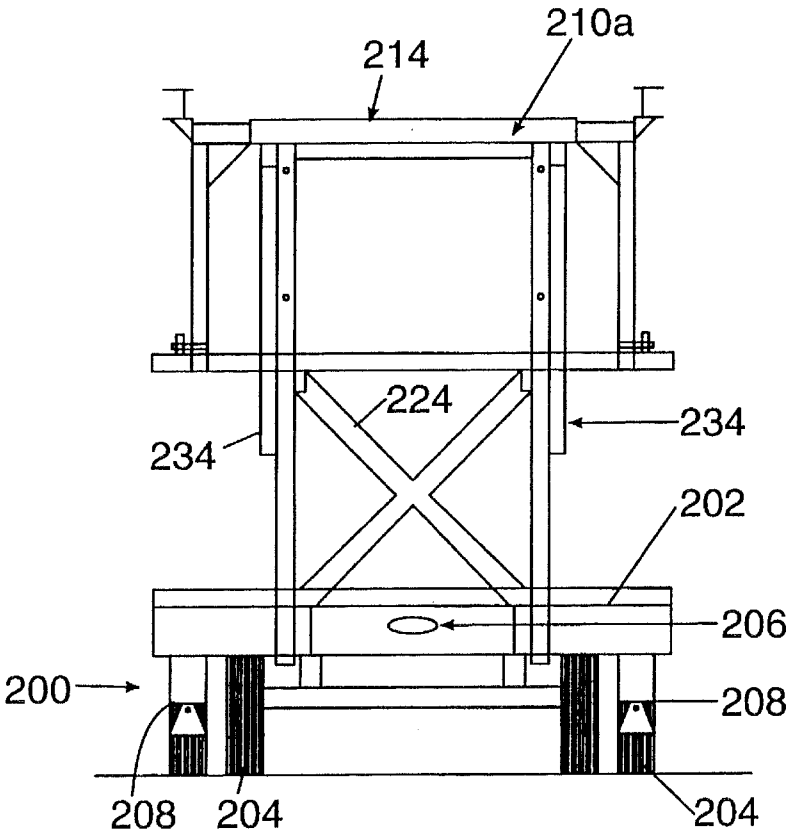
FIG. 2 is a front elevational view of the trailer and the work platform assembly of FIG. 1.

A trailer and an environmentally safe work platform assembly of the present invention, as pictured in FIGS. 1–3, are respectively designated generally by reference numerals 200 and 100. Trailer 200 is particularly useful in transporting and vertically positioning work platform assembly 100. Trailer 200 includes a trailer bed 202, a plurality of wheels 204 for rollingly supporting trailer bed 202, a trailer hitch 206, leveling stands 208, and front and rear lifting assemblies **210*a* and 210*b* for interfacing with, supporting, and vertically positioning work platform assembly 100. To aid in the understanding of trailer 200, a brief description of the environmentally safe work platform assembly 100 is first presented below. A more detailed description of trailer 200** appears thereafter.

At the outset, it should be noted that only an abridged description of environmentally safe work platform assembly 100 is provided herein. Additional details directed to the structure and use of work platform assembly 100 are included in copending U.S. patent application Ser. No. 08/172,925, which has been incorporated herein by reference.

Figure 4:
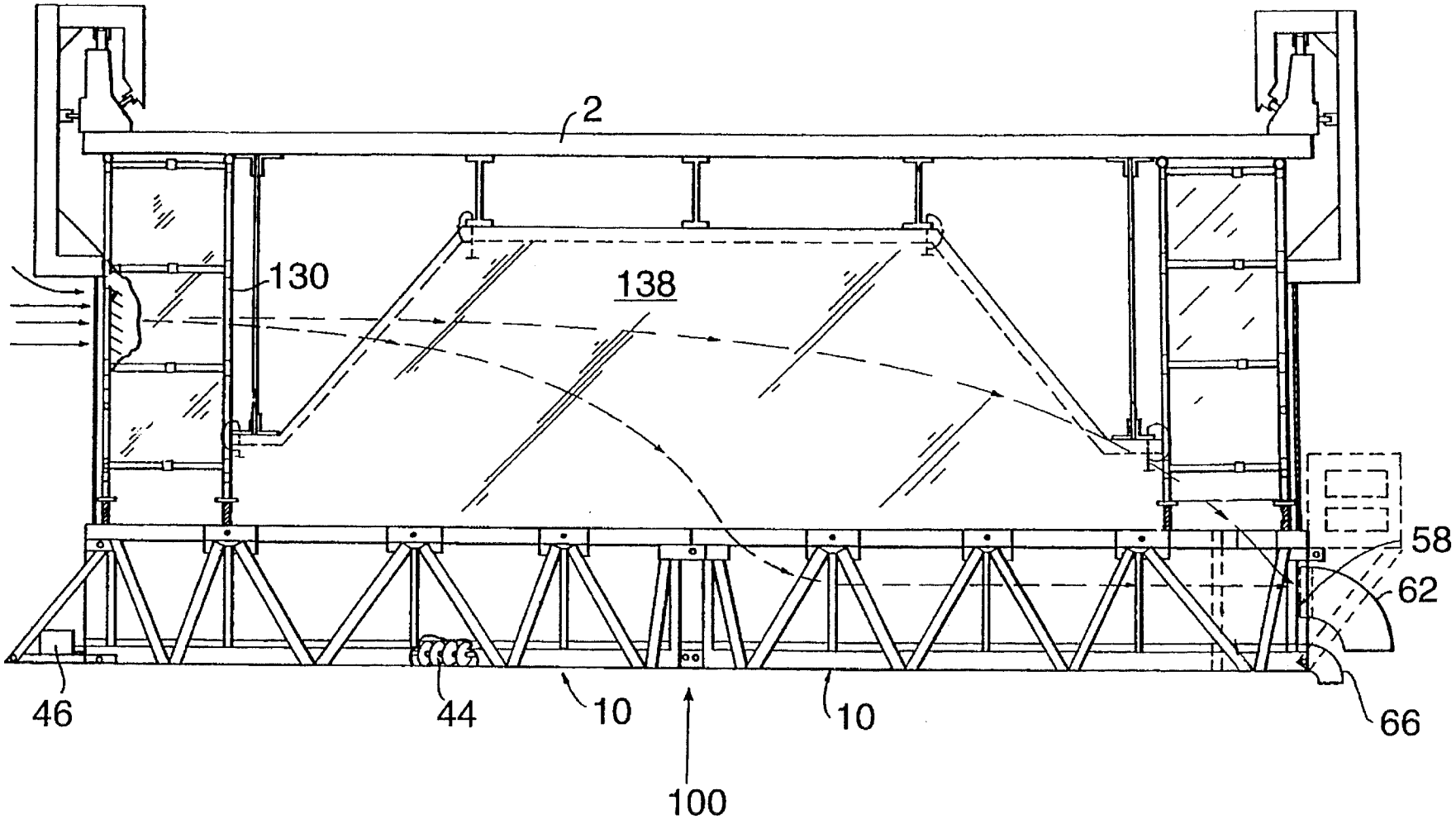
FIG. 4 is an elevational view of the work platform assembly of the invention in an operational, suspended position beneath a bridge.
Figure 5:
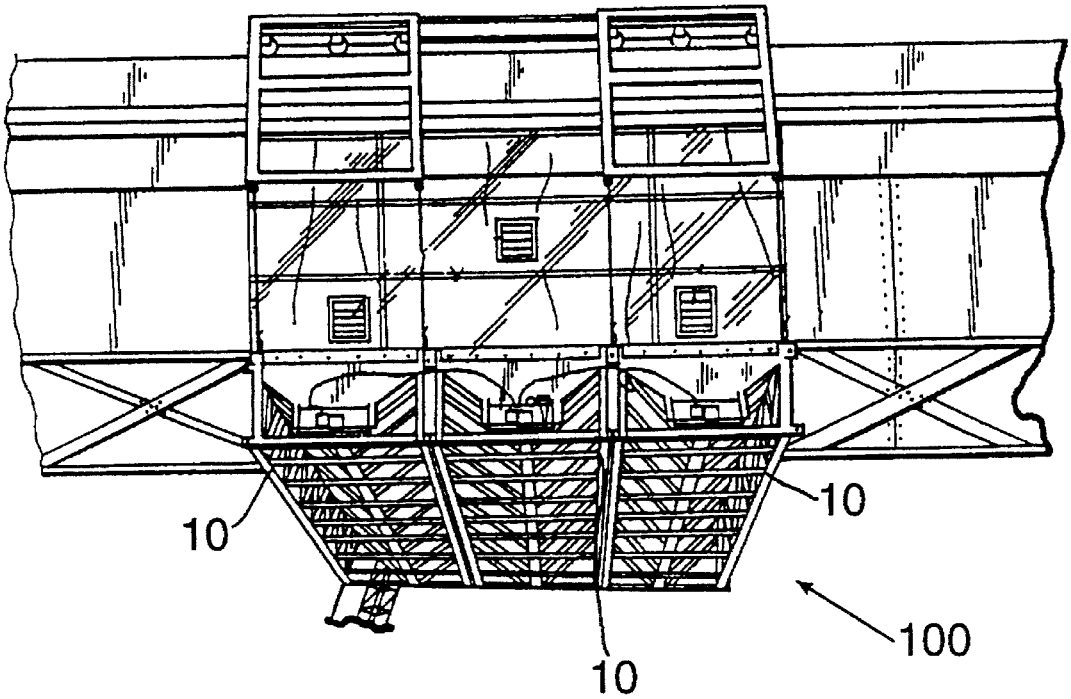
FIG. 5 is a perspective view of the left side of FIG. 4.
Figure 6:
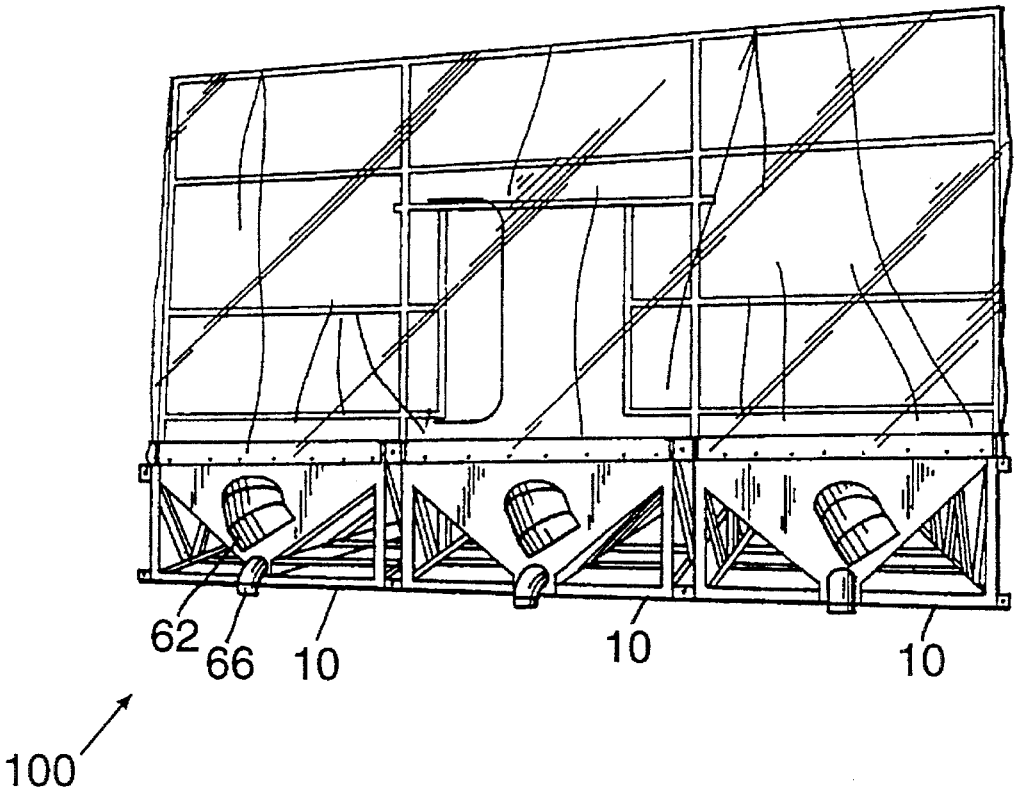
FIG. 6 is a perspective view of the right side of the work platform assembly of FIG. 4 after it has been lowered to ground level.

One embodiment of work platform assembly 100 is pictured in FIGS. 4–6, and is shown suspended by a bridge having a surface to be treated. Work platform assembly 100 preferably includes a base comprised of a plurality of interconnected modules 10 which can be connected in end-to-end and side-by-side relationships to adjacent modules. FIGS. 4–6 depict assembly 100 as including a two-by-three array of six interconnected modules 10, two in an end-to-end relationship, and three in a side-by-side relationship. However, as will be apparent from the description of trailer 200, the preferred embodiment for use with trailer 200 includes two modules 10 connected in an end-to-end relationship.

Figure 7:
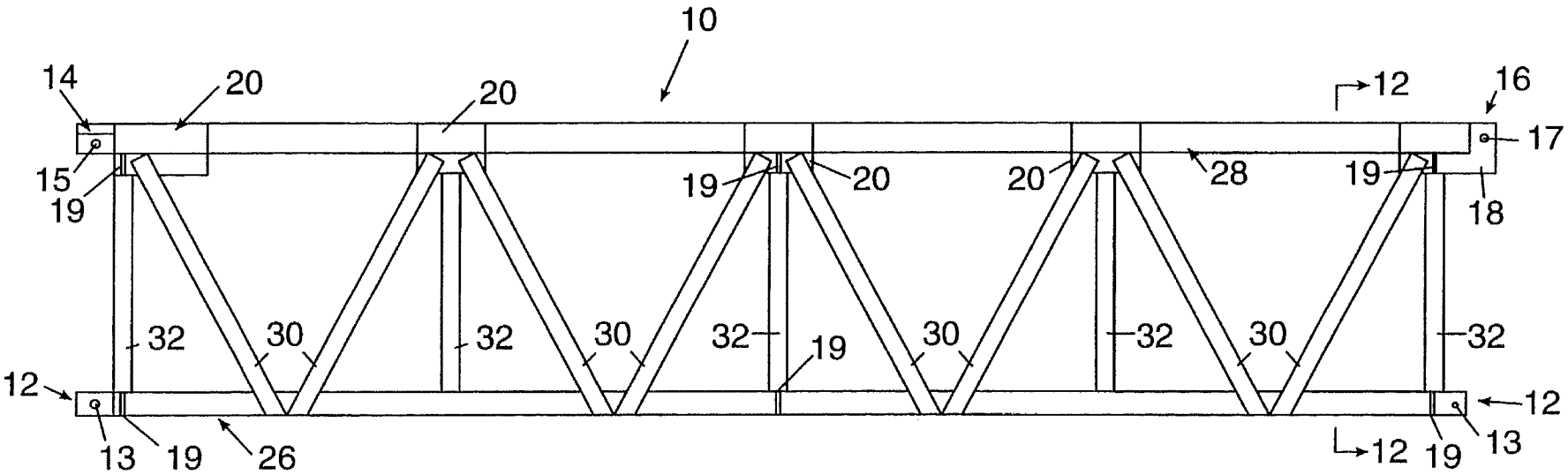
FIG. 7 is an elevational view of the basic platform module.

With reference to FIGS. 7–12, each module 10 comprises a side truss structure extending lengthwise and along each side. As seen in FIG. 7, each such side truss has a top chord 28 and bottom chord 26. As seen in the cross-sectional view of FIG. 12, top chord 28 is made up of two C-beams which are spaced apart, back-to-back, by gussets 20 which also provide points of attachment between the C-beams at several locations along the length of the chord 28. Lower chord 26 is an inverted T-beam. L-beams 32 extend vertically between top chord 28 and bottom chord 26, with L-beams 30 extending diagonally between top chord 28 and bottom chord 26, as seen in FIG. 7.

Figure 8:
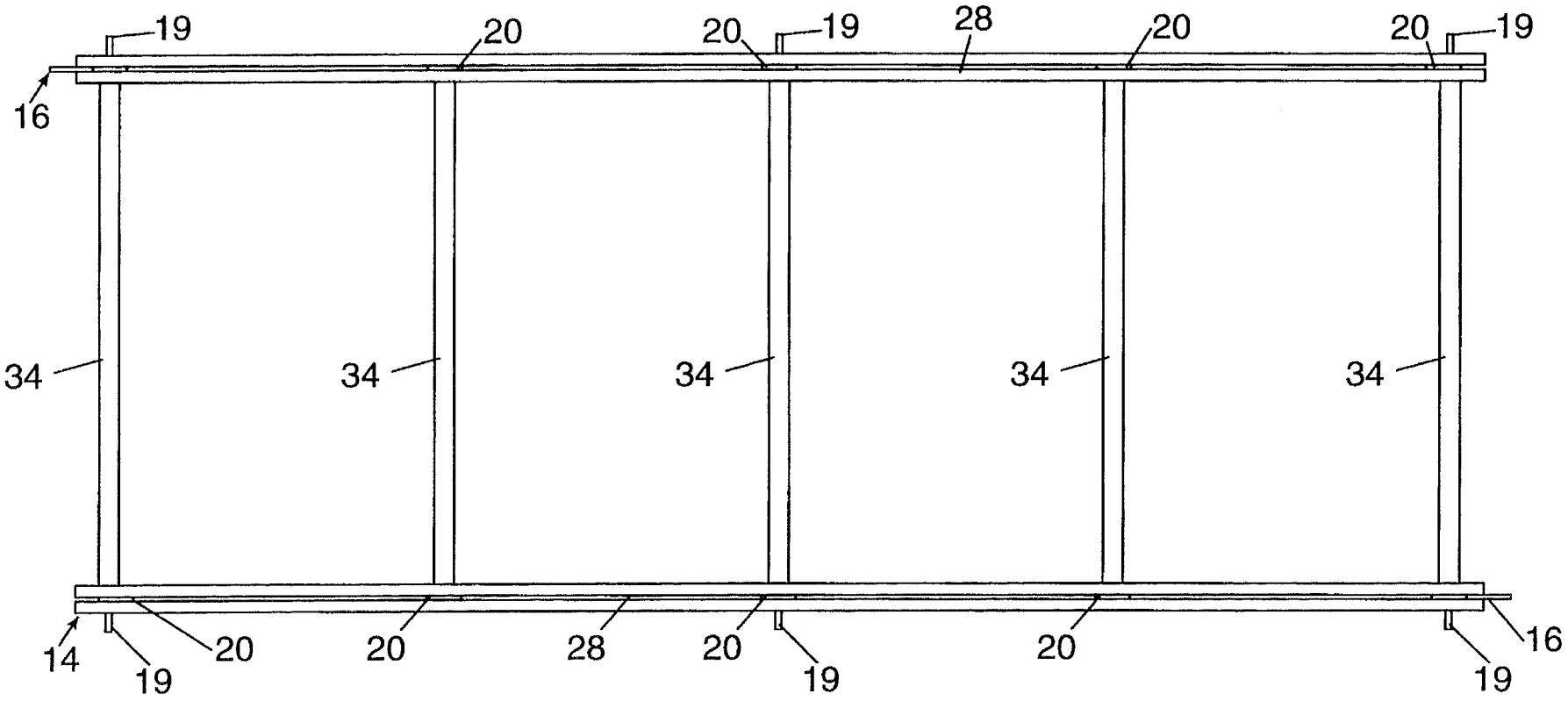
FIG. 8 is a top plan view of the module of FIG. 7 with the grating removed therefrom.
Figure 12:
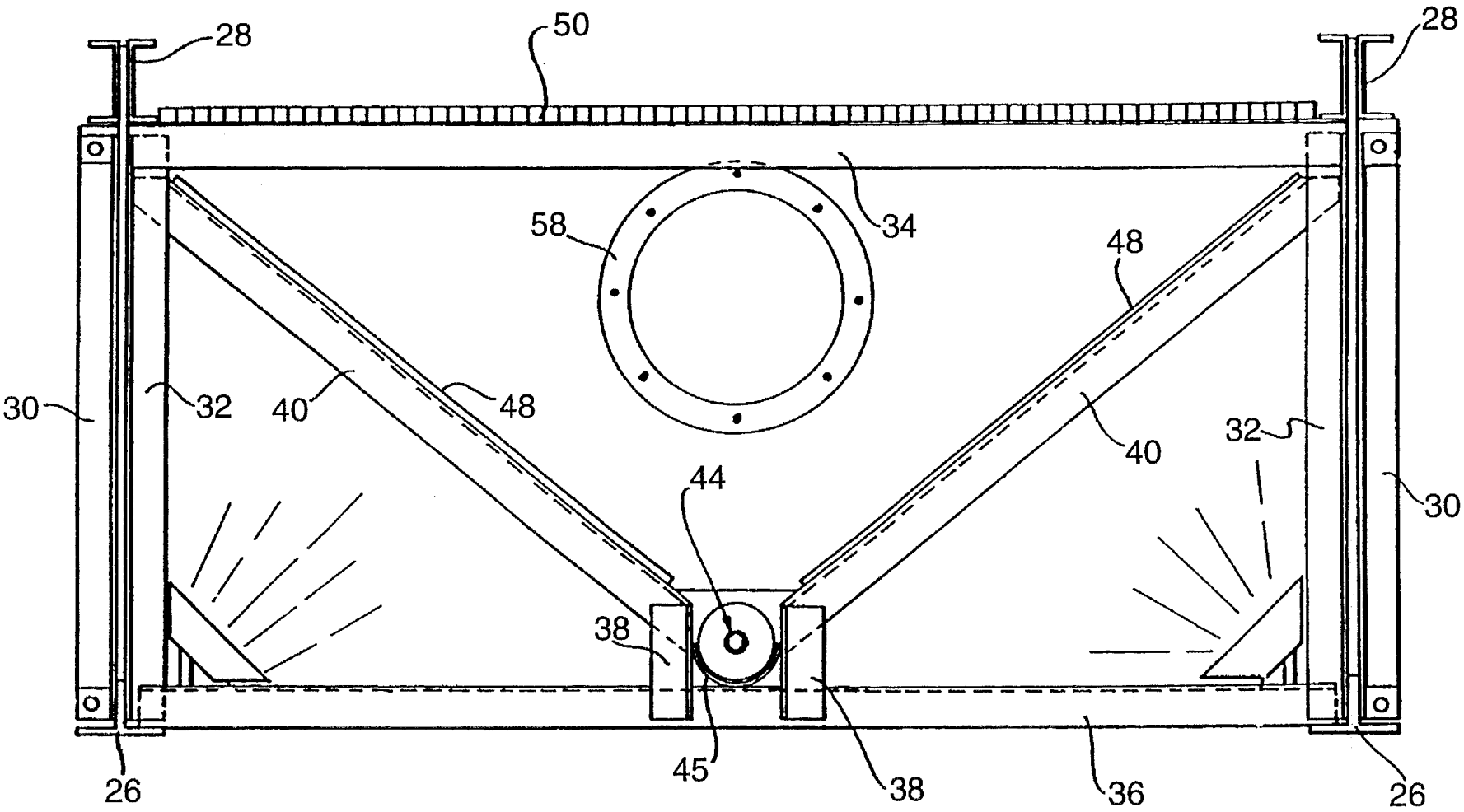
FIG. 12 is a cross-section of FIG. 7, as viewed generally in the direction of arrows 12—12.

Referring to FIGS. 8 and 12, each module 10 also has upper lateral L-beams 34 and lower lateral L-beams 36 extending between the side truss structures. Beams 34 and 36, in combination with the short center posts 38 and lateral diagonal beams 40, provide a lateral truss structure which is oriented perpendicular to the planes of the side truss structures.

Figure 10:
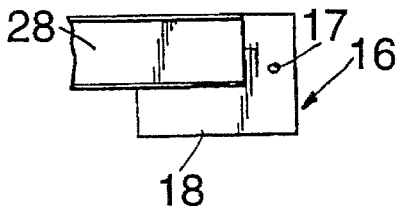
FIG. 10 is a partial elevation of a protruding connection point for the top chord.

Referring particularly to FIGS. 7–10, each top chord 28 has a "protruding connection point" 16 on one end thereof and a "flush connection point" 14 on the other end thereof. The flush connection point 14 preferably comprises aligned holes 15 through the back-to-back C-beams of top chord 28. Aligned holes 15 are slightly inwardly spaced from the end of top chord 28, as been seen in FIGS. 7 and 9. The protruding connection point 16 is provided by an end connection plate 18 which has a hole 17 therein. End connection plate 18 is attached to the end of the C-beams opposite flush connection point 14, as best seen in FIGS. 7 and 10. Thus, when connecting top chords 28 in series, i.e., end-to-end, end connection plate 18 of protruding connection 16 fits between C-beams of flush connection point 14 whereby holes 15 and 17 are aligned for reception of a pin (not shown) to complete the connection. It should be noted that the positioning and design of the connection points for top chord 28, as disclosed herein, slightly differ from their counterparts disclosed in U.S. patent application Ser. No. 08/172,925. However, it is recognized that the arrangement disclosed in U.S. patent application Ser. No. 08/172,925, as well as other suitable arrangements, could be used.

Figure 11:
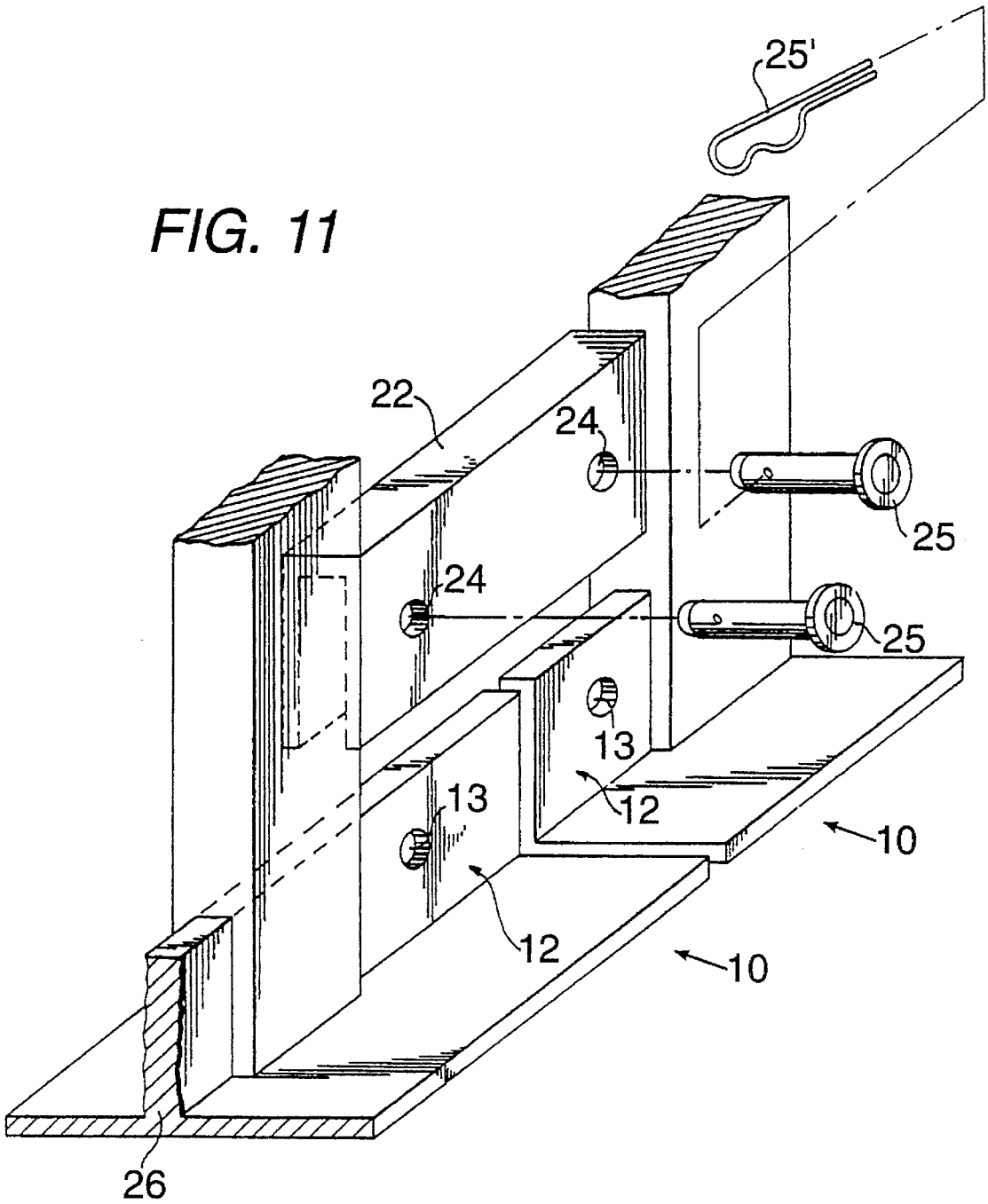
FIG. 11 is a perspective, partially exploded view of the special connection of two bottom chords end-to-end.
Figure 9:
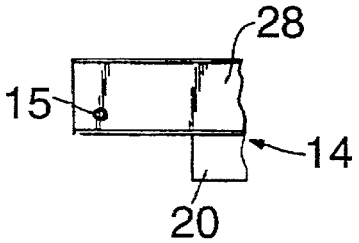
FIG. 9 is a partial elevation of a flush connection point for the top chord.

With particular reference to FIGS. 7 and 11, each end of bottom chord 26 has a connection point 12 including a hole 13 so that an inverted U-shaped connector 22 may receive vertically protruding portions of end-to-end bottom chords such that holes 24 on connector 22 align with holes 13 of the abutted bottom chords 26. Pins or bolts 25 are inserted into the aligned holes, and hairpin spring clips 25' or the like are used to complete the connection. In general, unless otherwise noted, pins 25 and clips 25' or the like are used at all connection points on platform assembly 100 which require a specific retention device.

Accommodation is provided for the top chord connections 14 and 16 by spacing holes 15 and 17 such that a slight gap will remain between the ends of series connected top chords 28 when fully loaded or stressed to a straightened condition. Such a slight gap will allow connection of top chords 28 end-to-end when they are unloaded and, thus, not face-to-face parallel at the so-called abutting ends.

For the bottom chords 26, a similar accommodation is provided by connector 22. The holes 24 thereof are sized slightly larger than holes 13 of bottom chords 26 and are spaced appropriately from the top of connector 22, as viewed in FIG. 11, so as to accommodate non-parallelism of the faces of the so-called abutting ends of bottom chords 26 when in an unloaded or unstressed condition. It also is provided that the vertically protruding portion of the lower chords 26 engage and abut the inside surface of the top portion of connector 22 when fully stressed or loaded to a straightened or uncambered condition of the chords 26.

Thus, each end-to-end pair of modules 10 is pinned together at bottom points 12 and top points 14, 16. Further, each such pair of end-to-end modules may also be connected to an adjoining other pair of modules 10 by pinning the side-to-side adjacent modules together at side connection points 19, as shown in FIGS. 7 and 8, which protrude laterally outward from their top and bottom truss chords 26, 28. Gaps between adjoining ends and sides of modules 10 may be prevented by the use of filler strips, not shown.

Upper end connection points 14 and 16 and lower end connection points 12 of work platform assembly 100 may be used to interface with trailer 200 in addition to their use in joining adjacent modules 10. The interface between end connection points 12, 14, and 16 and trailer 200 is described in detail hereinafter.

As best shown in FIG. 12 each module 10 further includes a grating 50 supported by beams 34 for workers to stand upon and walk to address the metal surfaces to be treated, e.g., stripped and recoated. Angled wall panels 48 define a V-shaped hopper located below grating 50 which extends the full length of module 10. The bottom apex of the hoppers include a semi-circular pipe housing 45 which houses an auger section 44, i.e., a mechanical screw conveyor. Housings of adjacent end-to-end modules 10 are connected, while the housings of adjacent side-by-side modules 10 are independent. The auger sections 44 form a complete auger string resulting from the end-to-end connection of modules 10. Each auger string is driven by a motor 46, preferably pneumatic, at one end.

Also, as seen in FIG. 4, an elbow 66 is attached at the end of each auger string 44 to receive the particulate material exiting from the enclosure. A conduit may be attached to each of the elbows 66, and a vacuum can be utilized to remove the particulate material that has been moved out of the module troughs via its auger string 44. One end of each module 10 also has an exhaust port 58 which is positioned below the grating 50 and above the auger 44. Work platform assembly 100 may have an elbow 62 attached to exhaust port 58 to facilitate connection of large vacuum hoses for exhausting airborne particles and dust from the modules 10.

Figure 13:
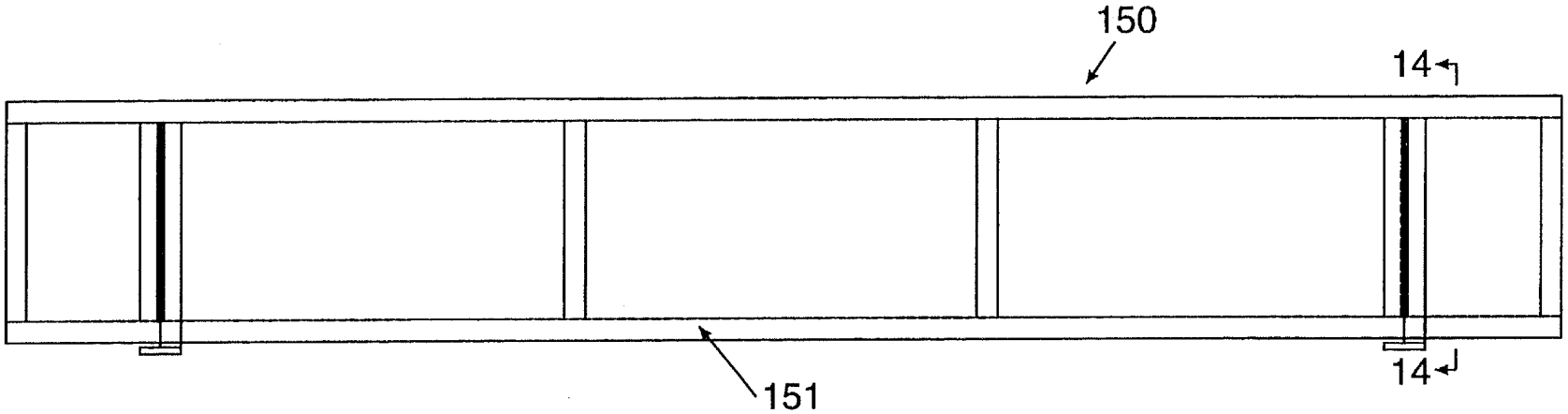
FIG. 13 is a view of the pivotal extension wing frame panel for the work platform assembly.
Figure 14:
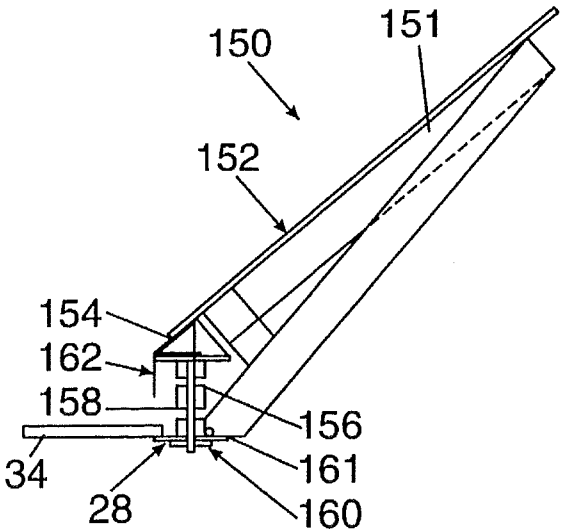
FIG. 14 is a sectional view of the pivotal extension wing frame panel of FIG. 13.

Work platform assembly 100 may also include extension wing frame panels 150, as shown in FIGS. 13 and 14. Extension wing frame panels 150 extend longitudinally along modules 10 and are pivotally attached to top chords 28. Extension wing frame panels 150 laterally extend the dimensions of work platform assembly 100 to address a larger area of the bridge deck surfaces.

As depicted in FIG. 14, extension wing frame panels 150 include a frame 151 with a translucent carbonate panel 152 mounted thereon. Frame 151 is pivotally attached, via hinge 154, to L-shaped member 156 and vertical plate 158. Vertical plate 158 is inserted between the back-to-back C-beams of top chords 28. The bottom of vertical plate 158 extends below top chord 28, and includes holes, not shown, permitting attachment pins 160 to be inserted therein and retain extension wing frame panels 150 with respect to modules 10. When pivoted to its use position as shown in FIG. 14, a load bearing portion 161 of frame 151 is supported by the lower flange of the outer C-beam of top chord 28. A closure strip 162 may be used to seal the area between wing frame panels 150 and modules 10.

Referring back to FIGS. 1–3, trailer 200 includes a trailer body 202, a plurality of wheels 204, a trailer hitch 206, leveling stands 208, and front and rear lifting assemblies **210*a* and 210*b* for interfacing with, supporting, and vertically positioning work platform assembly 100**.

Front and rear lifting assemblies 210 are respectively affixed to the front and rear portions of the trailer bed 202. Rear lifting assembly **210*b* is depicted in FIGS. 15–18. Front lifting assembly 210*a* is identical to rear lifting assembly 210*b*, except that front lifting assembly 210*a* is displaced longitudinally substantially the length of work platform assembly 100, and displaced angularly 180° , to interface with work platform assembly 100**.

Lifting assembly 210 includes a fixed portion 212 and a lifting frame 214 vertically movable with respect to fixed portion 212. Fixed portion 212 includes fixed vertical column members 216 which are attached to main trailer beams 218, either directly, and/or via brackets 220. The upper ends of fixed vertical column members 216 are interconnected by horizontal bar 221 to accurately space the column members 216 and provide additional strength to fixed portion 212. Fixed portion 212 is preferably further strengthened by using angled braces 222 and a cross brace 224. Support blocks 223 may be mounted to horizontal bar 221 to support lifting frame 214 in a lowered position.

Figure 16:
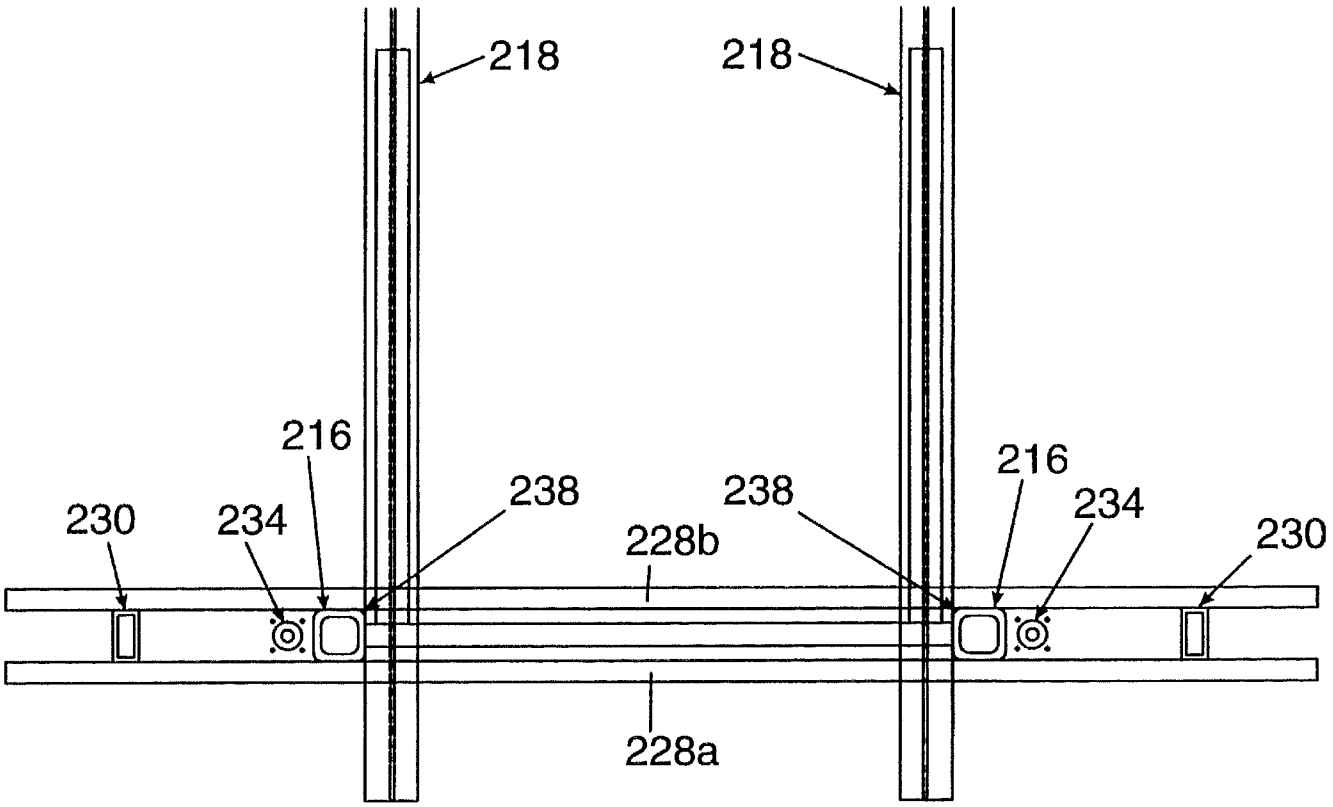
FIG. 16 is a cross-sectional view of the lift assembly of FIG. 15, as viewed generally in the direction of arrows 16—16.

Lifting frame 214 is telescopically with respect to fixed portion 212, and more specifically with respect to fixed vertical column members 216. Lifting frame 214 interfaces with and supports an end of work platform assembly 100. Lifting frame 214 is rectangular and includes at least one upper horizontal cross member 226, a pair of lower horizontal cross members 228, and a pair of vertical joining members 230 which fixedly attach upper horizontal cross member 226 to the lower horizontal cross members 228. Corner brackets 229 are attached to upper horizontal cross member 226 and to a respective vertical joining member 230 to add strength and stability to lifting frame 214. Lifting frame 214 further includes movable vertical column members 232 each having an upper portion affixed to the upper horizontal cross member 226 and a lower portion located within a respective fixed vertical column member 216. As seen in FIG. 16, movable column members 232 are nested within fixed column members 216, for vertical movement therewithin.

Figure 15:
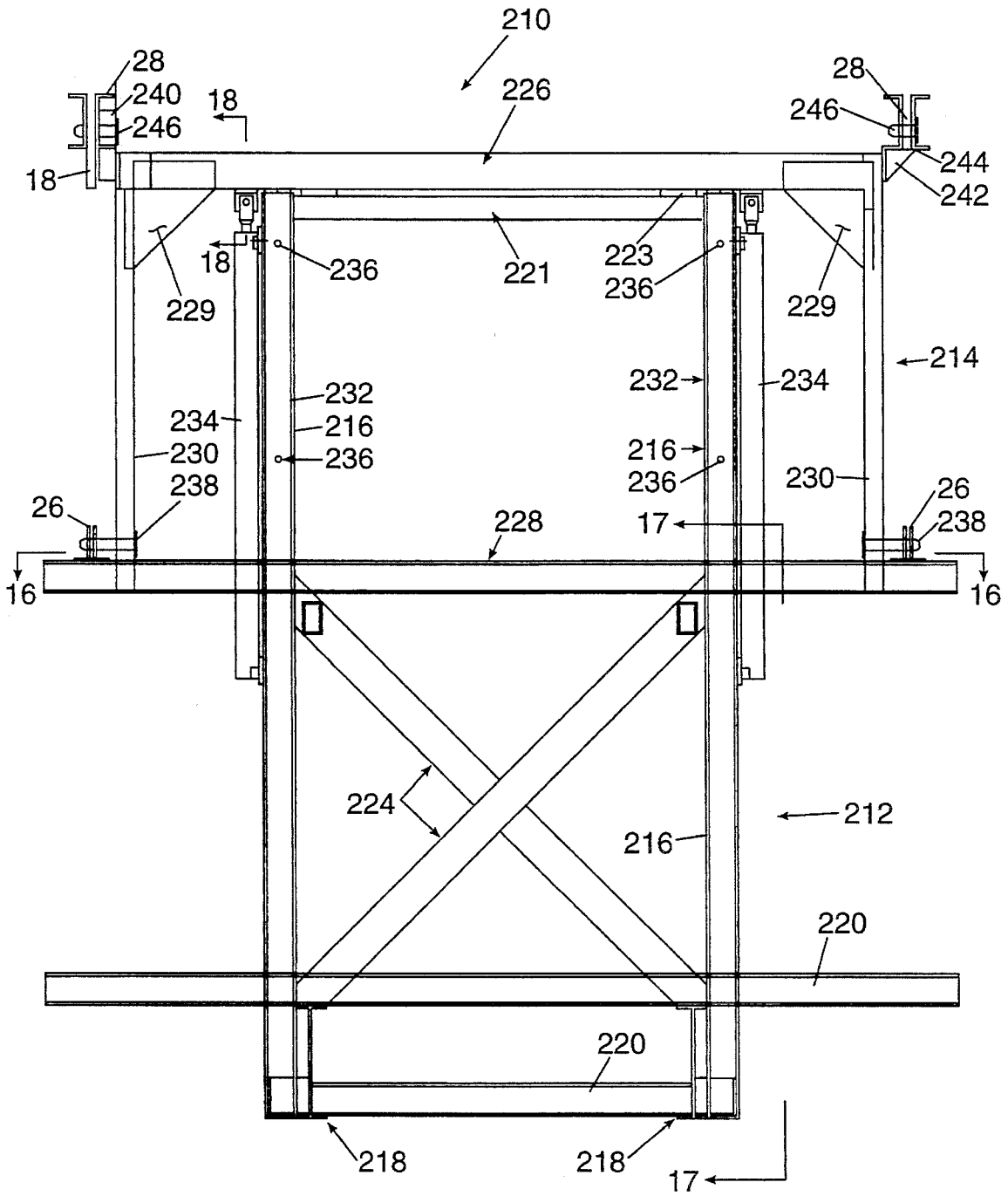
FIG. 15 is a rear elevational view of the work platform lift assembly.
Figure 18:
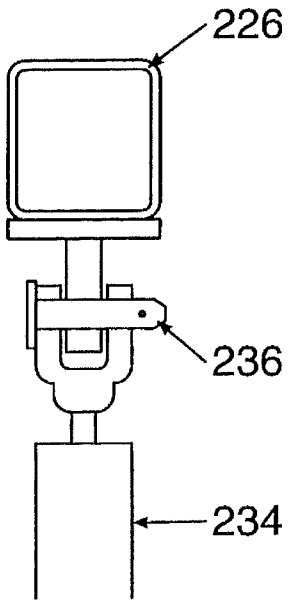
FIG. 18 is a cross-sectional view of the lift assembly of FIG. 15 as viewed generally in the direction of arrows 18—18.
Figure 17:
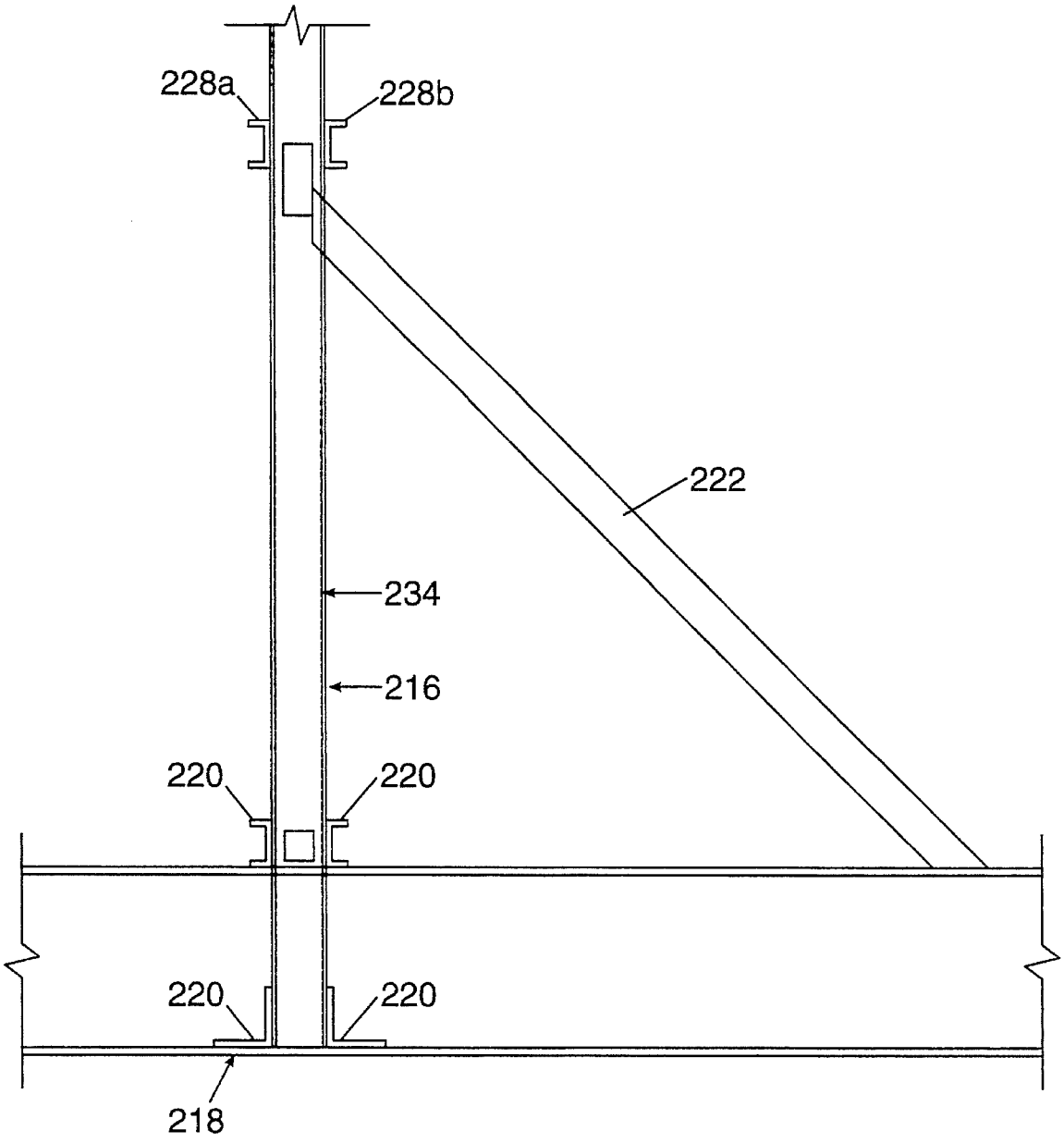
FIG. 17 is a cross-sectional view of the lift assembly of FIG. 15, as viewed generally in the direction of arrows 17—17.

As shown in FIGS. 15 and 18, a pair of hydraulic cylinders 234 is mounted at their upper ends to upper horizontal member 226 of lifting frame 214, and at their lower ends to a respective fixed vertical column member 216. As shown in FIG. 18, the coupling arrangement between hydraulic cylinder 234 and upper horizontal member 226 includes aligned holes with a retaining pin 236 inserted therethrough. This coupling prevents slight differences in tolerances between the two cylinders 234 from affecting the vertical movement of lifting frame 214.

Lifting cylinders 234 are controlled in a manner known in the art. The extension and retraction of the lifting cylinders telescopically move the lifting frame 214 with movable vertical column members 232, with respect to the fixed vertical column members 216 and fixed portion 212. As lifting frames 214 are each coupled to an end of work platform assembly 100, the extension and retraction of cylinders 234 also vertically move an end of work platform assembly 100. Holes 236 in fixed vertical column member 214 can be aligned with one of a plurality of vertically spaced holes in movable column member 232 to permit a safety reinforcing pin to be inserted therethrough. This feature retains lifting frame 214 in a raised position in the event of cylinder failure.

Each end of work platform assembly 100 is supported by, and coupled to, a lifting assembly 210. Inner lower horizontal cross member **228*b* contacts and supports an end lower lateral L-beam 36 on work platform assembly 100. Work platform assembly 100 is also structurally coupled at its upper and lower end corners to lifting frame 214**.

As seen in FIG. 15, holes 15 in bottom chords 26 are aligned with holes, not shown, in vertical joining members 230. Retaining pins 238 are inserted through the aligned holes to couple the lower portions of work platform assembly 100 to lifting frame 214.

Lifting frame 214 is also coupled to the upper portion of work platform assembly 100 via holes 15 in flush connection point 14 and holes 17 in protruding connection point 16. As seen in FIG. 15, a rigid vertical interface plate 240 welded to one lateral end of upper horizontal cross member 226 includes a hole which aligns with hole 17 in end connection plate 18 of protruding connection point 16. A structural retaining pin 246 is inserted through hole in interface plate 240 and hole 17 in end connection plate 18.

An extension angle bracket 242 and a vertical connection plate 244 are welded to the other lateral end of upper horizontal cross member 226. Vertical connection plate 244 fits within C-beams of top chord 28. A hole in vertical plate 244 aligns with hole 15 in flush connection point 14. A structural retaining pin 246 is inserted through the aligned holes to structurally couple the upper portion of work platform assembly 100 to lifting frame 214. It should be noted that the work platform assembly interfacing holes on opposite ends of upper cross member 226 are longitudinally offset from each other to compensate for the longitudinal offset spacing of holes between flush connecting point 14 and protruding connecting point 16.

Figure 19:
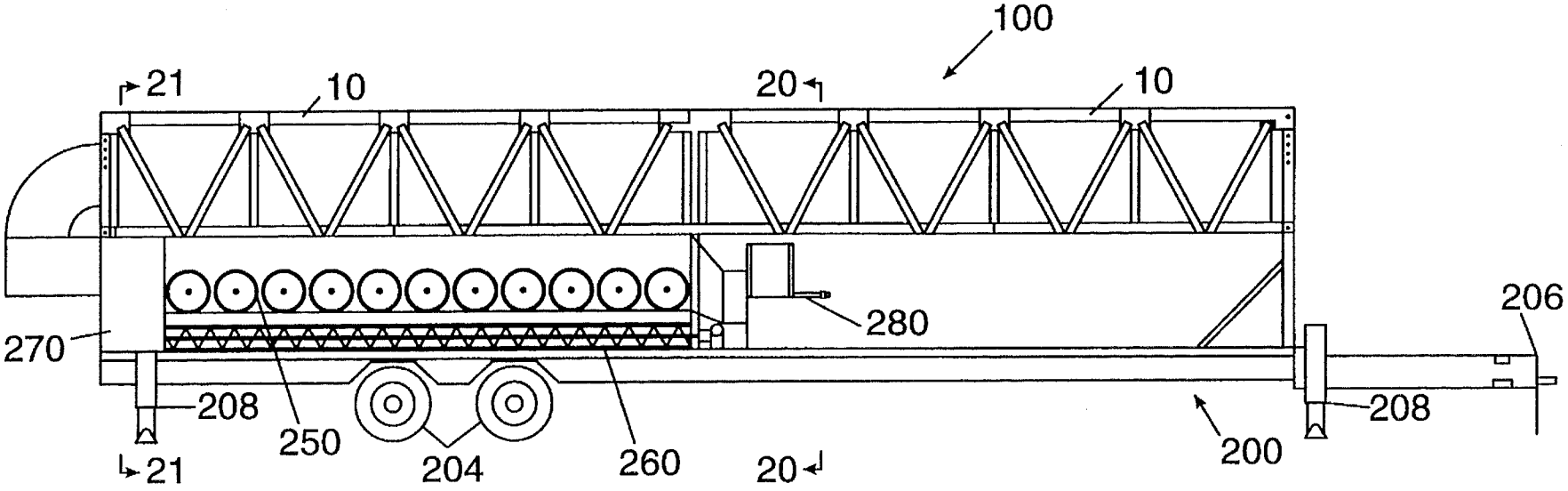
FIG. 19 is a side elevational view of the trailer and work platform assembly of FIG. 1, shown with a dust collection system and a residue separation system attached to the trailer bed.
Figure 20:
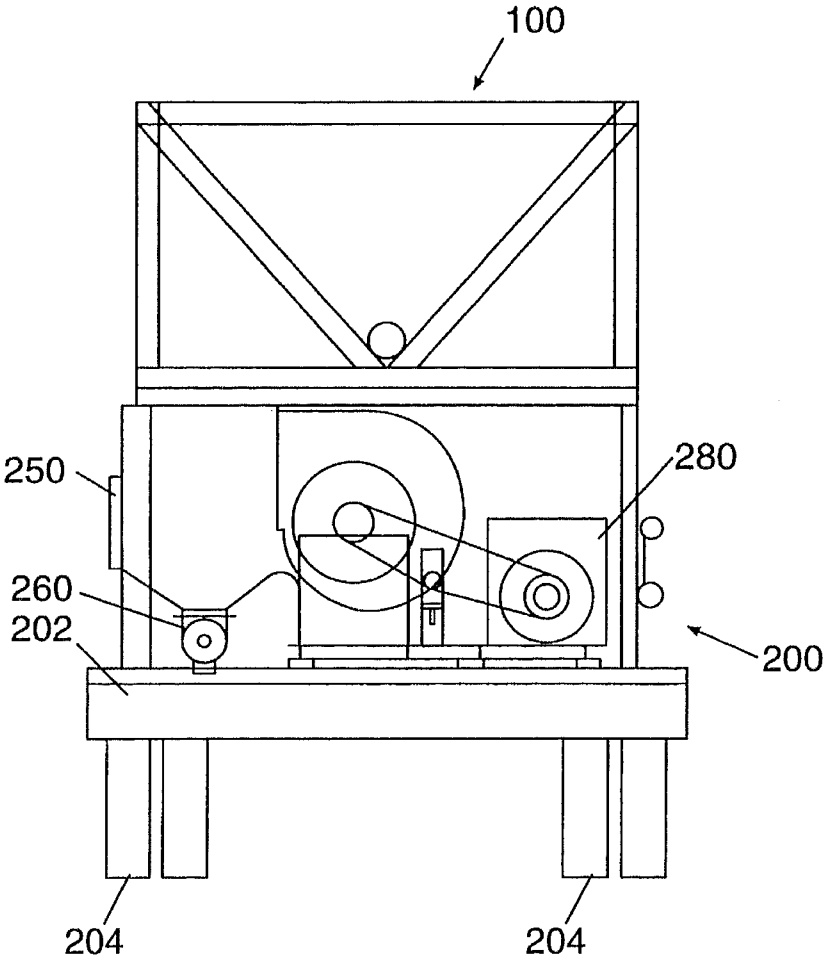
FIG. 20 is a cross-sectional view of the trailer and work platform assembly of FIG. 19, as viewed generally in the direction of arrows 20—20.
Figure 21:
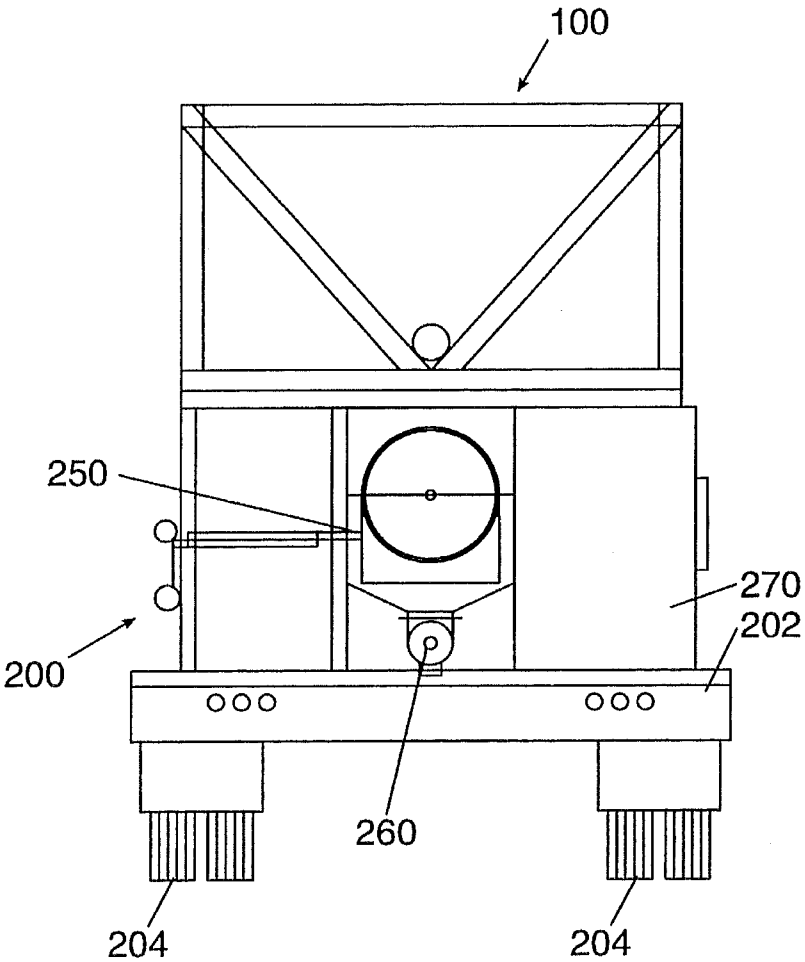
FIG. 21 is a cross-sectional view of the trailer and work platform assembly of FIG. 19, as viewed generally in the direction of arrows 21—21.

As seen FIGS. 19–21, it is preferable that trailer bed 202 have a dust collection system 250, a residue separation system 260, sand blasting media pots 270, and a lift cylinder drive system 280 removably mounted thereon. Dust collection system 250 preferably includes a fan for creating a vacuum, filters, and a drum for containing removed particles. A conduit, not shown, is used to operatively connect the dust collection system 250 to elbow 62 so that the vacuum created by the fan can be applied to the enclosure.

Residue separation system 260, e.g. a classifier, includes a magnetic separator, an air wash, or both, and separates the residue ejected by auger 44 out of elbow 66. Residue separation system 260 preferably includes a fan and a conduit, not shown, connecting the classifier and elbow 66 to facilitate the transfer of residue from auger 44 to separation system 260.

Blasting media pots 270 are hoppers mounted to the trailer body for containing sand or another form of blast media used for treating the bridge surfaces.

Lift cylinder drive system 280 preferably includes an engine and controls the flow of hydraulic fluid to lift cylinders 234. Thus, lift cylinder drive system 280 can extend and retract cylinders 234 to respectively raise and lower lifting frames 214 and work platform assembly 100.

Dust containment systems, residue separation systems, blasting media pots and lift cylinder drive systems are each schematically illustrated in FIGS. 19–21 and are individually known in the art.

In operation, a work platform assembly 100, preferably comprised of two modules 10 connected end-to-end, is loaded on trailer 200 and structurally attached at its ends to lifting frames 214, in a lowered transport position, via retention pins 238, 246. Trailer 200 is driven to the site of a bridge deck including surfaces to be treated. Work platform assembly 100 is centered under the bridge deck and lifting cylinders 234 are extended to a raised position at a height immediately adjacent the underside of the bridge deck. The extension and retraction of lifting cylinders 234 are controlled via lift cylinder drive system 280. It is preferable that the cylinders have a minimum stroke of four feet-eight inches to access many bridge deck surfaces.

An enclosure is formed which serves to visually define boundaries of work platform assembly 100 and to prevent toxic dust and particulates resulting from the blasting process from contaminating or otherwise affecting the environment. The enclosure may optionally be formed by end frames, telescopically adjustable wing frames 130, side curtains 138, and/or compressible seals as disclosed in U.S. patent application Ser. No. 08/172,925. Further, the enclosure may utilize tarps, screens, panels, or any other suitable members for substantially sealing the enclosure to the underside of the bridge deck. This prevents residue and other particles given off during the surface treatment from entering the environment. If extension wing frame panels 150 are used, they are first inserted and pivoted outwardly, and the structure forming the enclosure is attached to panels 150.

The bridge deck surfaces can be treated with blast media which is stored in pots 270. While the surfaces are being treated, work platform assembly 100 separates heavy particulate material from the airborne residue and evacuates each from the enclosure. The heavier residue and particulate material used during the blasting process fall down through the grating 50 and into the troughs under the force of gravity. The heavier residue and particulate material are then positively driven out of the enclosure and into the elbow 66 by the auger 44. A vacuum applied to elbow 66 moves the material already inside the elbow, i.e., outside the enclosure, to residue separation system 260 for recycling and/or reconditioning.

The airborne residue is evacuated from the enclosure by a vacuum applied to elbow 62, into dust collection system 250, for subsequent disposal in a manner which does not contaminate the environment.

Thus, a totally enclosed work platform assembly 100 and trailers 200 are provided for transporting the work platform assembly 100 to a bridge deck, vertically positioning the platform assembly 100, and for treating bridge deck surfaces, without the need for suspending the work platform assembly 100 from the bridge deck and without contaminating the environment by the residue of lead-based paint previously used to coat the surfaces.

While particular embodiments of the invention have been shown and described, it is recognized that various modifications thereof will occur to those skilled in the art. Therefore, the scope of the herein-described invention shall be limited solely by the claims appended hereto.

I claim:

1. A trailer for use with a work platform assembly, said trailer for transporting and vertically repositioning the work platform assembly to the underside of a deck, the work platform assembly providing support for worker access to, and the treatment of, surfaces of supporting structures of the deck, the work platform assembly having an assembly frame having a forward portion and a rearward portion, a trough extending longitudinally of the work platform assembly for collecting particulate material at a bottom thereof, grating positioned atop the trough for supporting a worker thereon and allowing particulate material to pass therethrough into the trough, a conveyor for discharging the particulate material from the trough inlet means for introducing air into the work platform assembly from the outside environment and an exhaust port for applying vacuum therethrough to the work platform assembly and exhausting the air therefrom, so as to cause airborne portions of residue to be entrained in an air current extending from the inlet means to the exhaust port, and a forward and a rearward lifting interface for interfacing with and attachment to said trailer, the forward lifting interface located adjacent the forward portion of the assembly frame and the rearward lifting interface located adjacent the rearward portion of the assembly frame; said trailer comprising:

a substantially horizontal trailer bed having a forward portion and a rearward portion;

wheels for rollingly supporting the trailer bed on a supporting surface;

front and rear lifting assemblies, said front lifting assembly being fixedly attached to the forward portion of the trailer bed and said rear lifting assembly being fixedly attached to the rearward portion of the trailer bed;

each said lifting assembly including a lifting frame and at least one lifting cylinder, said lifting frame of the front lifting assembly intended for supporting the forward portion of the assembly frame of the work platform assembly, said lifting frame of the rear lifting assembly intended for supporting the rearward portion of the assembly frame of the work platform assembly;

front and rear fastening means, said front fastening means intended for removably attaching the forward lifting interface of the work platform assembly to the lifting frame of the front lifting assembly, said rear fastening means intended for removably attaching the rearward lifting interface of the work platform assembly to the lifting frame of the rear lifting assembly;

each said lifting cylinder having a lower end structurally coupled to said trailer body and an upper end structurally attached to its respective lifting frame, each said lifting cylinder being substantially vertically oriented;

fluid control means operatively coupled to the lifting cylinders for controlling the flow of fluid to and from the lifting cylinders, and thereby causing the lifting cylinders to extend or retract, wherein the extension and retraction of the lifting cylinders move the lifting frames and the work platform assembly substantially vertically with respect to the trailer bed; and a dust collection system having a vacuum fan and a conduit for connecting the exhaust port to said vacuum fan; said dust collection system being attached to said trailer bed.

2. A trailer for use with a work platform assembly, said trailer for transporting and vertically repositioning the work platform assembly to the underside of a deck, the work platform assembly providing support for worker access to, and the treatment of, surfaces of supposing structures of the deck, the work platform assembly having an assembly frame having a forward portion and a rearward portion, a trough extending longitudinally of the work platform assembly for collecting particulate material at a bottom thereof, grating positioned atop the trough for supporting a worker thereon and allowing particulate material to pass therethrough into the trough, a conveyor for discharging the particulate material from the trough at least one auger, an auger driving motor, and a forward and a rearward lifting interface for interfacing with and attachment to said trailer, the forward lifting interface located adjacent the forward portion of the assembly frame and the rearward lifting interface located adjacent the rearward portion of the assembly frame and trailer comprising:

a substantially horizontal trailer bed having a forward portion and a rearward portion;

wheels for rollingly supporting the trailer bed on a supporting surface;

front and rear lifting assemblies, said front lifting assembly being fixedly attached to the forward portion of the trailer bed and said rear lifting assembly being fixedly attached to the rearward portion of the trailer bed;

each said lifting assembly including a lifting frame and at least one lifting cylinder, said lifting frame of the front lifting assembly intended for supporting the forward portion of the assembly frame of the work platform assembly, said lifting frame of the rear lifting assembly intended for supporting the rearward portion of the assembly frame of the work platform assembly;

front and rear fastening means, said front fastening means intended for removably attaching the forward lifting interface of the work platform assembly to the lifting frame of the front lifting assembly, said rear fastening means intended for removably attaching the rearward lifting interface of the work platform assembly to the lifting frame of the rear lifting assembly;

each said lifting cylinder having a lower end structurally coupled to said trailer body and an upper end structurally attached to its respective lifting frame, each said lifting cylinder being substantially vertically oriented; and fluid control means operatively coupled to the lifting cylinders for controlling the flow of fluid to and from the lifting cylinders, and thereby causing the lifting cylinders to extend or retract, wherein the extension and retraction of the lifting cylinders move the lifting frames and the work platform assembly substantially vertically with respect to the trailer bed; and a residue separation system and a conduit for connecting said auger to said residue separation system; said residue separation system being attached to said trailer bed.

3. A trailer for use with a work platform assembly, said trailer for transporting and vertically repositioning the work platform assembly to the underside of a deck, the work platform assembly providing support for worker access to, and the treatment of, surfaces of supporting structures of the deck, the work platform assembly having an assembly frame having a forward portion and a rearward portion, a trough extending longitudinally of the work platform assembly for collecting particulate material at a bottom thereof, grating positioned atop the trough for supporting a worker thereon and allowing particulate material to pass therethrough into the trough, a conveyor for discharging the particulate material from the trough, and a forward and a rearward lifting interface for interfacing with and attachment to said trailer, the forward lifting interface located adjacent the forward portion of the assembly frame and the rearward lifting interface located adjacent the rearward portion of the assembly frame; said trailer comprising:

a substantially horizontal trailer bed having a forward portion and a rearward portion;

wheels for rollingly supporting the trailer bed on a supporting surface;

front and rear lifting assemblies, said front lifting assembly being fixedly attached to the forward portion of the trailer bed and said rear lifting assembly being fixedly attached to the rearward portion of the trailer bed;

each said lifting assembly including a lifting frame, at least one lifting cylinder, and a fixed vertical column member, said lifting frame of the front lifting assembly intended for supporting the forward portion of the assembly frame of the work platform assembly, said lifting frame of the rear lifting assembly intended for supporting the rearward portion of the assembly frame of the work platform assembly, each said lifting frame including at least one upper horizontal cross member, a pair of lower horizontal cross members, at least one vertical joining member fixedly attached to said upper horizontal cross member and to both said lower horizontal cross members, and a movable vertical column member having an upper portion affixed to said upper horizontal cross member and a lower portion located within said fixed vertical column member;

front and rear fastening means, said front fastening means intended for removably attaching the forward lifting interface of the work platform assembly to the lifting frame of the front lifting assembly, said rear fastening means intended for removably attaching the rearward lifting interface of the work platform assembly to the lifting frame of the rear lifting assembly;

each said lifting cylinder having a lower end structurally coupled to said trailer body and an upper end structurally attached to its respective lifting frame, each said lifting cylinder being substantially vertically oriented; and fluid control means operatively coupled to the lifting cylinders for controlling the flow of fluid to and from the lifting cylinders, and thereby causing the lifting cylinders to extend or retract, wherein the extension and retraction of the lifting cylinders move the lifting frames and the work platform assembly substantially vertically with respect to the trailer bed by telescopically moving the movable vertical column member with respect to the fixed vertical column member;

wherein said pair of lower horizontal cross members of each lifting frame includes an inner horizontal cross member located longitudinally inwardly of the fixed vertical column member and an outer horizontal cross member located longitudinally outwardly of the fixed vertical column member, said inner horizontal cross member having a supporting surface for contacting and supporting a respective end of the assembly frame of the work platform assembly.

4. A trailer as in claim 3, wherein said fixed vertical column member of each lifting assembly having a connector receiving hole therein, and said movable vertical column member of each lifting frame including a plurality of vertically spaced connector receiving holes therein, said trailer further comprising a safety locking member insertable between the connector receiving hole in the fixed vertical column members and an aligned connector receiving hole in the movable vertical column member.

5. A trailer for use with a work platform assembly, said trailer for transporting and vertically repositioning the work platform assembly to the underside of a deck, the work platform assembly providing support for worker access to, and the treatment of, surfaces of supporting structures of the deck, the work platform assembly having an assembly frame having a forward portion and a rearward portion, a trough extending longitudinally of the work platform assembly for collecting particulate material at a bottom thereof, grating positioned atop the trough for supporting a worker thereon and allowing particulate material to pass therethrough into the trough, a conveyor for discharging the particulate material from the trough, and a forward and a rearward lifting interface for interfacing with and attachment to said trailer, the forward lifting interface located adjacent the forward portion of the assembly frame and the rearward lifting interface located adjacent the rearward portion of the assembly frame; said trailer comprising:

a substantially horizontal trailer bed having a forward portion and a rearward portion;

wheels for rollingly supporting the trailer bed on a supporting surface;

front and rear lifting assemblies, said front lifting assembly being fixedly attached to the forward portion of the trailer bed and said rear lifting assembly being fixedly attached to the rearward portion of the trailer bed;

each said lifting assembly including a lifting frame, at least one lifting cylinder, and a fixed vertical column member, said lifting frame of the front lifting assembly intended for supporting the forward portion of the assembly frame of the work platform assembly, said lifting frame of the rear lifting assembly intended for supporting the rearward portion of the assembly frame of the work platform assembly each said lifting frame including at least one upper horizontal cross member, a pair of lower horizontal cross members, at least one vertical joining member fixedly attached to said upper horizontal cross member and to both said lower horizontal cross members, and a movable vertical column member having an upper portion affixed to said upper horizontal cross member and a lower portion located within said fixed vertical column member;

front and rear fastening means, said front fastening means intended for removably attaching the forward lifting interface of the work platform assembly to the lifting frame of the front lifting assembly, said rear fastening means intended for removably attaching the rearward lifting interface of the work platform assembly to the lifting frame of the rear lifting assembly;

each said lifting cylinder having a lower end structurally coupled to said trailer body and an upper end structurally attached to its respective lifting frame, each said lifting cylinder being substantially vertically oriented; and fluid control means operatively coupled to the lifting cylinders for controlling the flow of fluid to and from the lifting cylinders, and thereby causing the lifting cylinders to extend or retract, wherein the extension and retraction of the lifting cylinders move the lifting frames and the work platform assembly substantially vertically with respect to the trailer bed by telescopically moving the movable vertical column member with respect to the fixed vertical column member;

said front and rear fastening means each including right and left fastening plates having connector receiving holes therein and being attached to opposing portions of the respective upper horizontal cross member of their respective lifting frame, and fastening pins, each front and rear interfacing means including right and left plate members with connector receiving holes therein, each said fastening pin penetrating aligned connector receiving holes in a fastening plate and a respective plate member.

6. A trailer as in claim 5, wherein said connector receiving hole in said left fastening plate and said connector receiving hole in said right fastening plate in each fastening means is longitudinally offset from each other.

7. A trailer as in claim 5, each said front and rear fastening means each further including a connector receiving hole in its respective vertical joining member and a fastening pin, the fastening pin penetrating said connector receiving hole in its respective vertical joining member and a connector receiving hole located in a member on the respective lifting interface of the work platform assembly.

8. An apparatus for treating deck surfaces at a predetermined location, the apparatus comprising a trailer and work platform assembly coupled to the trailer, the trailer transporting and vertically repositioning the work platform assembly to the underside of a deck, the work platform assembly providing support for worker access to, and the treatment of, surfaces of supporting structures of the deck;

said work platform assembly comprising:

an assembly frame having a forward portion and a rearward portion;

a trough extending longitudinally of the work platform assembly for collecting particulate material at a bottom thereof;

grating positioned atop the trough for supporting a worker thereon and allowing particulate material to pass therethrough into the trough;

an exhaust port;

a conveyor for discharging the particulate material from the trough; and inlet means for introducing air into the work platform assembly from the outside environment and an exhaust port for applying vacuum therethrough to the work platform assembly and exhausting the air therefrom, so as to cause airborne portions of residue to be entrained in an air current extending from the inlet means to the exhaust port;

said trailer comprising:

a substantially horizontal trailer bed having a forward portion and a rearward portion, and wheels for rollingly supporting the trailer bed on a supporting surface;

front and rear lifting assemblies, said front lifting assembly being fixedly attached to the forward portion of the trailer bed and said rear lifting assembly being fixedly attached to the rearward portion of the trailer bed, each said lifting assembly including at least one lifting cylinder, each said lifting cylinder having a lower end structurally coupled to said trailer body and an upper end structurally attached to the work platform assembly, each said lifting cylinder being substantially vertically oriented;

fluid control means operatively coupled to the lifting cylinders for controlling the flow of fluid to and from the lifting cylinders, and thereby causing the lifting cylinders to extend or retract, wherein the extension and retraction of the lifting cylinders move the lifting frames and the work platform assembly substantially vertically with respect to the trailer bed; and a dust collection system having a vacuum fan and a conduit for connecting the exhaust port to said vacuum fan; said dust collection system being attached to said trailer bed.

9. The apparatus of claim 8, said work platform assembly further comprising a forward and rearward lifting interface for interfacing with and attachment to said trailer, the forward lifting interface located adjacent the forward portion of the assembly frame and the rearward lifting interface located adjacent the rearward portion of the assembly frame.

10. The apparatus of claim 9, wherein each said lifting assembly further includes a lifting frame, said lifting frame of the front lifting assembly supporting the forward portion of the assembly frame of the work platform assembly, said lifting frame of the rear lifting assembly supporting the rearward portion of the assembly frame of the work platform assembly.

11. The apparatus of claim 10, further including front and rear fastening means, said front fastening means for removably attaching the forward lifting interface of the work platform assembly to the lifting frame of the front lifting assembly, said rear fastening means for removably attaching the rearward lifting interface of the work platform assembly to the lifting frame of the rear lifting assembly.

12. An apparatus for treating deck surfaces at a predetermined location, the apparatus comprising a trailer and work platform assembly coupled to the trailer, the trailer for transporting and vertically repositioning the work platform assembly to the underside of a deck, the work platform assembly providing support for worker access to, and the treatment of, surfaces of supporting structures of the deck;

said work platform assembly comprising:

an assembly frame having a forward portion and a rearward portion;

a trough extending longitudinally of the work platform assembly for collecting particulate material at a bottom thereof;

grating positioned atop the trough for supporting a worker thereon and allowing particulate material to pass therethrough into the trough;

a conveyor for discharging the particulate material from the trough; and at least one auger within the trough and an auger driving motor;

said trailer comprising:

a substantially horizontal trailer bed having a forward portion and a rearward portion, and wheels for rollingly supporting the trailer bed on a supporting surface;

front and rear lifting assemblies, said front lifting assembly being attached to the forward portion of the trailer bed and said rear lifting assembly being attached to the rearward portion of the trailer bed;

each said lifting assembly including at least one lifting cylinder, each said lifting cylinder having a lower end structurally coupled to said trailer body and an upper end structurally attached to the work platform assembly, each said lifting cylinder being substantially vertically oriented;

fluid control means operatively coupled to the lifting cylinders for controlling the flow of fluid to and from the lifting cylinders, and thereby causing the lifting cylinders to extend or retract, wherein the extension and retraction of the lifting cylinders move the lifting frames and the work platform assembly substantially vertically with respect to the trailer bed; and a residue separation system and a conduit for connecting said auger to said residue separation system; said residue separation system being attached to said trailer bed.

13. An apparatus for treating deck surfaces at a predetermined location, the apparatus comprising a trailer and work platform assembly removably attached to the trailer, the trailer for transporting and vertically repositioning the work platform assembly to the underside of a deck, the work platform assembly providing support for worker access to, and the treatment of, surfaces of supporting structures of the deck;

said work platform assembly comprising:

an assembly frame having a forward portion and a rearward portion;

a trough extending longitudinally of the work platform assembly for collecting particulate material at a bottom thereof;

grating positioned atop the trough for supporting a worker thereon and allowing particulate material to pass therethrough into the trough;

a conveyor for discharging the particulate material from the trough; and a forward and a rearward lifting interface for interfacing with and attachment to said trailer, the forward lifting interface located adjacent the forward portion of the assembly frame and the rearward lifting interface located adjacent the rearward portion of the assembly frame;

said trailer comprising:

a substantially horizontal trailer bed having a forward portion and a rearward portion, and wheels for rollingly supporting the trailer bed on a supporting surface;

front and rear lifting assemblies, said front lifting assembly being fixedly attached to the forward portion of the trailer bed and said rear lifting assembly being fixedly attached to the rearward position of the trailer bed, each said lifting assembly including at least one lifting cylinder, each said lifting cylinder having a lower end structurally coupled to said trailer body and an upper end structurally attached to the work platform assembly, each said lifting cylinder being substantially vertically oriented;

fluid control means operatively coupled to the lifting cylinders for controlling the flow of fluid to and from the lifting cylinders, and thereby causing the lifting cylinders to extend or retract, wherein the extension and retraction of the lifting cylinders move the lifting frames and the work platform assembly substantially vertically with respect to the trailer bed;

each said lifting assembly further including a fixed vertical column member, each said lifting frame including at least one upper horizontal cross member, a pair of lower horizontal cross members, at least one vertical joining member fixedly attached to said upper horizontal cross member and to both said lower horizontal cross members, and a movable vertical column member having an upper portion affixed to said upper horizontal cross member and a lower portion located within said fixed vertical column member, wherein the extension and retraction of the lifting cylinders telescopically move the movable vertical column member with respect to the fixed vertical column member;

front and rear fastening means, said front fastening means for removably attaching the forward lifting interface of the work platform assembly to the lifting frame of the front lifting assembly, said rear fastening means for removably attaching the rearward lifting interface of the work platform assembly to the lifting frame of the rear lifting assembly, said front and rear fastening means each including right and left fastening plates having connector receiving holes therein and being attached to opposing portions of the respective upper horizontal cross member of their respective lifting frame, and fastening pins, each forward and rearward interfacing including right and left plate members with connector receiving holes therein, each said fastening pin penetrating aligned connector receiving holes in a fastening plate and a respective plate member.

14. An apparatus as in claim 13, wherein in each said fastening means, said connector receiving hole in said left fastening plate being longitudinally offset from the connector receiving hole in said right fastening plate.

15. An apparatus as in claim 13, the work platform assembly having a plurality of longitudinally connected modules including first and second modules, each module having forward and rearward lifting interfaces, the forward lifting interface of the first module being the forward lifting interface for the work platform assembly, the rearward lifting interface of the second module being the rearward lifting interface for the work platform assembly, the rearward lifting interface of the first module being structurally attached to the forward lifting interface of the second module.

16. An apparatus for treating deck surfaces at a predetermined location, the apparatus comprising a trailer and work platform assembly coupled to the trailer, the trailer for transporting and vertically repositioning the work platform assembly to the underside of a deck, the work platform assembly providing support for worker access to, and the treatment of, surfaces of supporting structures of the deck;

said work platform assembly comprising:

an assembly frame having a forward portion and a rearward portion;

a recovery hopper extending longitudinally of the work platform assembly for collecting particulate material at a bottom thereof; and an auger located in the recovery hopper for discharging the particulate material from the recovery hopper;

said trailer comprising:

a substantially horizontal trailer bed having a forward portion and a rearward portion;

wheels for rollingly supporting the trailer bed on a supporting surface; and a lifting mechanism for moving the work platform assembly substantially vertically with respect to the trailer bed.

17. The apparatus of claim 16, wherein said recovery hopper is a longitudinally oriented trough.

18. The apparatus of claim 16, further comprising grating positioned atop the recovery hopper for supporting a worker thereon and allowing particulate material to pass therethrough into the recovery hopper.

19. The apparatus of claim 16, further comprising a dust collection system mounted to the trailer, and a conduit coupled between the dust collection system and the work platform assembly, said dust collection system creates a vacuum inside the work platform assembly, and filters and contains particles removed from the work platform assembly.

20. The apparatus of claim 16, further comprising a residue separation system mounted to the trailer for classifying particles removed from the work platform assembly, and a conduit coupled between the residue separation system and the work platform assembly.

21. The apparatus of claim 16, further comprising at least one hopper mounted to the trailer body for containing blast media used for treating the surfaces.

22. The apparatus of claim 16, wherein the lifting mechanism includes a front lifting cylinder and a rear lifting cylinder, the front lifting cylinder coupled to the forward portion of the trailer bed and the forward portion of the work platform assembly, and said rear lifting assembly being coupled to the rearward portion of the trailer bed and the rearward portion of the work platform assembly, and fluid control means operatively coupled to the front and the rear lifting cylinders for controlling the flow of fluid to and from the front and rear lifting cylinders, and thereby causing the lifting cylinders to extend or retract, wherein the extension and retraction of the lifting cylinders move the work platform assembly substantially vertically with respect to the trailer bed.

23. A process for treating road deck surfaces at a predetermined location, the method comprising:

providing a trailer and work platform assembly movably coupled to the trailer;

transporting the trailer and work platform assembly translationally to a position below the surfaces to be treated:

raising the work platform assembly with respect to the trailer by extending piston-cylinder assemblies to place the work platform assembly at a position vertically adjacent the surfaces to be treated;

supporting a worker inside the work platform assembly;

treating the surfaces, said treating step creating loose particulate residue;

collecting the residue in recovery hopper in the work platform assembly;

conveying the particulate residue by an auger system in the recovery hopper on the work platform assembly; and collecting the conveyed particulate residue.

24. The process of claim 23, further comprising the steps of providing a dust collection system mounted to the trailer, and a conduit coupled between the dust collection system and the work platform assembly; creating a vacuum inside the work platform assembly by the dust collection system; and filtering particles removed from the work platform assembly by the dust collection system.

25. The process of claim 23, further comprising the steps of providing residue separation system mounted to the trailer, and a conduit coupled between the residue separation system and the work platform assembly; and classifying the conveyed particulate residue by the residue separation system.

26. The process of claim 23, further comprising the steps of providing at least one hopper mounted to the trailer body for containing blast media used for treating the surfaces; and conveying the blast media from the hopper to a treating device inside the work platform assembly to treat the surfaces.

* * * * *